US008932033B2

(12) United States Patent
Ouwenga

(10) Patent No.: US 8,932,033 B2
(45) Date of Patent: Jan. 13, 2015

(54) SUPERCHARGER TIMING GEAR OIL PUMP

(75) Inventor: Daniel R. Ouwenga, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 282 days.

(21) Appl. No.: 12/643,172

(22) Filed: Dec. 21, 2009

(65) Prior Publication Data

US 2011/0150671 A1 Jun. 23, 2011

(51) Int. Cl.

| | |
|---|---|
| ***F04C 18/16*** | (2006.01) |
| ***F01C 11/00*** | (2006.01) |
| ***F04C 18/12*** | (2006.01) |
| ***F04C 29/02*** | (2006.01) |

(52) U.S. Cl.

CPC ..... *F01C 11/008* (2013.01); *F04C 18/126* (2013.01); *F04C 29/025* (2013.01)

USPC ..... 417/410.4; 417/410.3; 418/206.2; 418/206.3; 418/206.8; 418/88

(58) Field of Classification Search

CPC ..... F04C 18/126; F04C 29/025

USPC ..... 417/410.3, 410.4; 418/206.2, 206.3, 418/206.8, 88

See application file for complete search history.

(56) References Cited

U.S. PATENT DOCUMENTS

| | | | | |
|---|---|---|---|---|
| 1,585,731 | A * | 5/1926 | Oakes | 184/31 |
| 2,883,001 | A * | 4/1959 | Dierksen | 184/31 |
| 3,583,371 | A * | 6/1971 | King | 418/88 |
| 4,383,802 | A | 5/1983 | Gianni et al. | |
| 4,844,044 | A * | 7/1989 | McGovern | 123/559.1 |
| 4,875,454 | A * | 10/1989 | Okimoto et al. | 123/559.3 |
| 5,203,683 | A * | 4/1993 | Yoshikawa et al. | 417/440 |
| 6,406,281 | B1 * | 6/2002 | Aggradi et al. | 418/88 |
| 7,296,983 | B2 * | 11/2007 | Okada et al. | 418/104 |
| 2007/0098585 | A1 * | 5/2007 | Yamamoto et al. | 418/201.1 |
| 2007/0274851 | A1 | 11/2007 | Beckmann et al. | |
| 2008/0053417 | A1 * | 3/2008 | Eybergen et al. | 123/559.3 |
| 2008/0175739 | A1 | 7/2008 | Prior | |
| 2009/0260357 | A1 | 10/2009 | Prior | |

FOREIGN PATENT DOCUMENTS

| | | |
|---|---|---|
| DE | 8714166 U1 | 1/1988 |
| DE | 202006007301 U1 | 8/2006 |
| EP | 2085616 A1 | 8/2009 |
| WO | 2008003657 A1 | 1/2008 |

OTHER PUBLICATIONS

European Search Report for Application No. 10819720.3 mailed Aug. 31, 2012.

* cited by examiner

*Primary Examiner* — Charles Freay
*Assistant Examiner* — Christopher Bobish

(57) ABSTRACT

A positive displacement pump is provided. The pump includes a housing, and first and second meshed rotors rotatably disposed in the housing and arranged to transform relatively low-pressure inlet port air into relatively high-pressure outlet port air. The pump additionally includes first and second meshed timing gears fixed relative to the first and second rotors, respectively, for preventing contact between the first and second rotors, and sufficiently enclosed to generate a flow of lubricating fluid. Furthermore, the blower includes an input drive adapted to be rotatably driven at speeds proportional to speeds of an internal combustion engine and arranged to drive the first and second timing gears.

21 Claims, 6 Drawing Sheets

SUPERCHARGER TIMING GEAR OIL PUMP

TECHNICAL FIELD

The present invention relates to an oil pump for a positive displacement supercharger, and, more particularly, to an oil pump provided by timing gears of a supercharger.

BACKGROUND OF THE INVENTION

It is known in the art to use positive displacement air pumps for supercharging internal combustion engines and for providing air for other purposes. Such a pump, when used as an automotive supercharger, may include a housing having a rotor cavity, an air inlet and an air outlet passage. In the cavity of the supercharger, a pair of meshed or interleaved rotors spin to pump air drawn through the inlet passage, and to subsequently discharge the air through the outlet passage.

A supercharger's internal components, such as gears and bearings, are commonly provided with lubrication via a specially formulated working fluid contained within the supercharger. Typically, such working fluid is delivered to the supercharger's internal components by splash lubrication.

SUMMARY OF THE INVENTION

One embodiment of the invention is directed to a positive displacement pump having a housing. The housing includes an inlet port for admitting relatively low-pressure inlet port air and an outlet port for discharging relatively high-pressure outlet port air. The pump also includes first and second meshed blower rotors rotatably disposed in the housing and arranged to transform relatively low-pressure inlet port air into relatively high-pressure outlet port air. The pump additionally includes first and second meshed timing gears fixed relative to the first and second rotors, respectively, for preventing contact between the first and second rotors, and sufficiently enclosed to generate a flow of lubricating fluid. Furthermore, the pump includes an input drive adapted to be rotatably driven by a positive torque at speeds proportional to speeds of an internal combustion engine. The input drive is arranged to drive the first and the second timing gears.

Another embodiment of the invention is directed to an internal combustion engine having a supercharger, such as the positive displacement pump described above.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
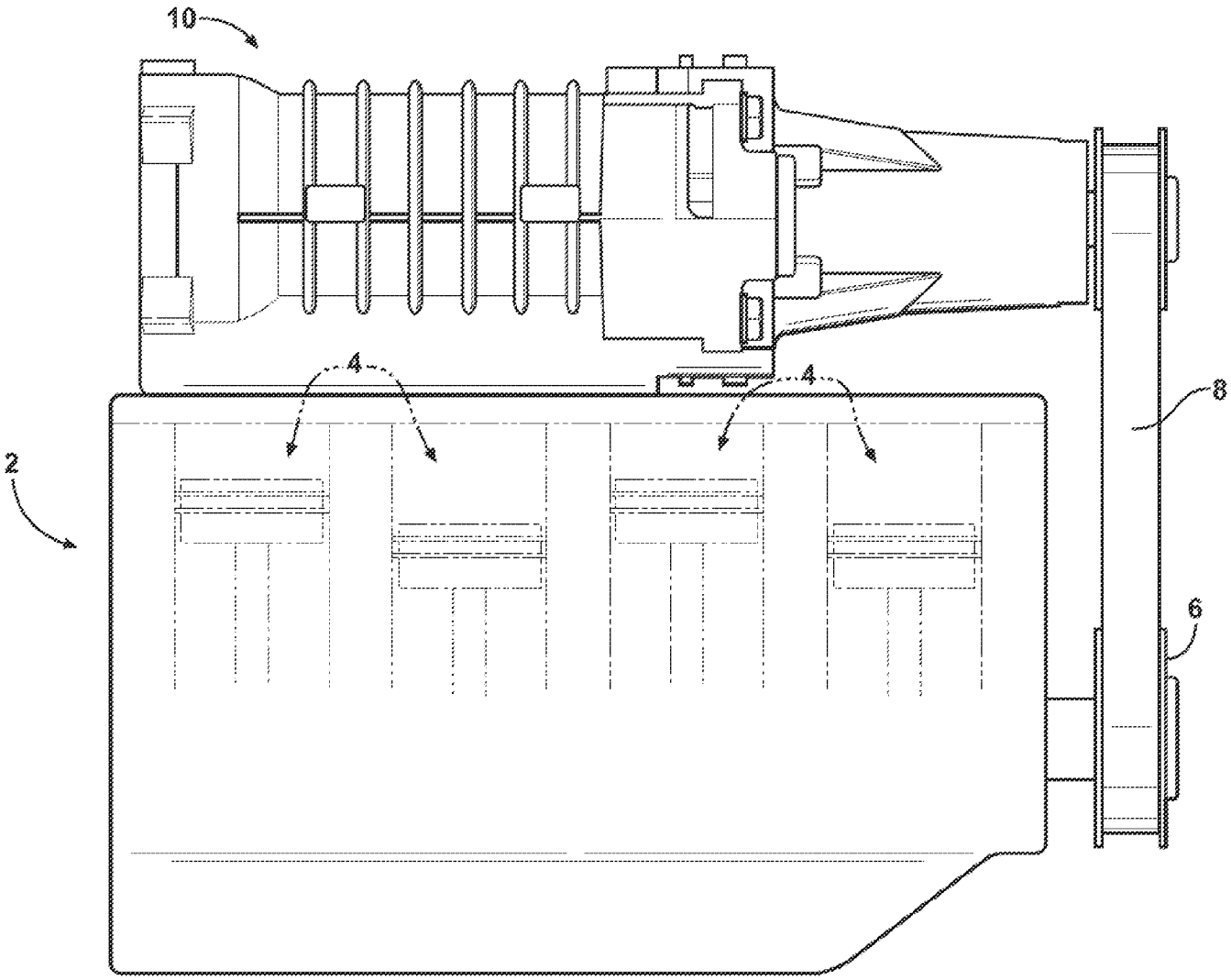
FIG. 1 is a side view of a supercharger assembly attached to an internal combustion engine.

Referring to the drawings wherein like reference numbers correspond to like or similar components throughout the several figures, FIG. 1 illustrates an internal combustion engine 2 having a plurality of combustion chambers 4, and a crankshaft pulley 6. Pulley 6 is driven by a crankshaft (not shown) of the engine 2, as understood by those skilled in the art. A compressor or supercharger assembly, generally indicated at 10, is shown attached to the engine 2. The supercharger assembly 10 is adapted for use with the internal combustion engine 2, and is operable to increase the volumetric efficiency thereof. The supercharger assembly 10 is driven by the engine 2 via a belt 8. Although the subject supercharger may be a roots-type supercharger having intermeshed lobed rotors, or a screw-type supercharger having intermeshed lobed rotors, a roots-type supercharger is shown in FIG. 2.

Figure 2:
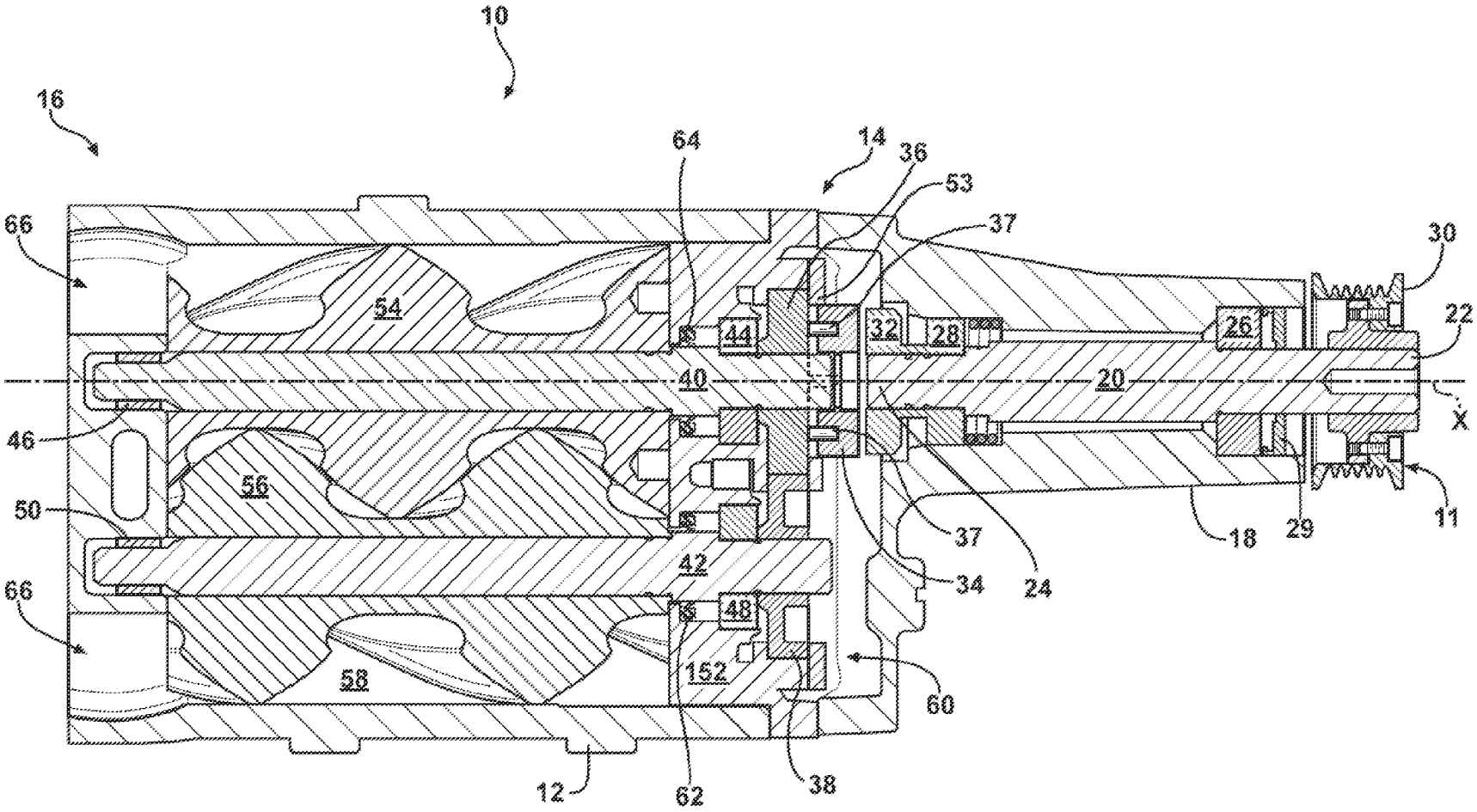
FIG. 2 is a sectional top view of the supercharger assembly showing meshed timing gears configured to pressurize a lubricating fluid.
Figure 3:
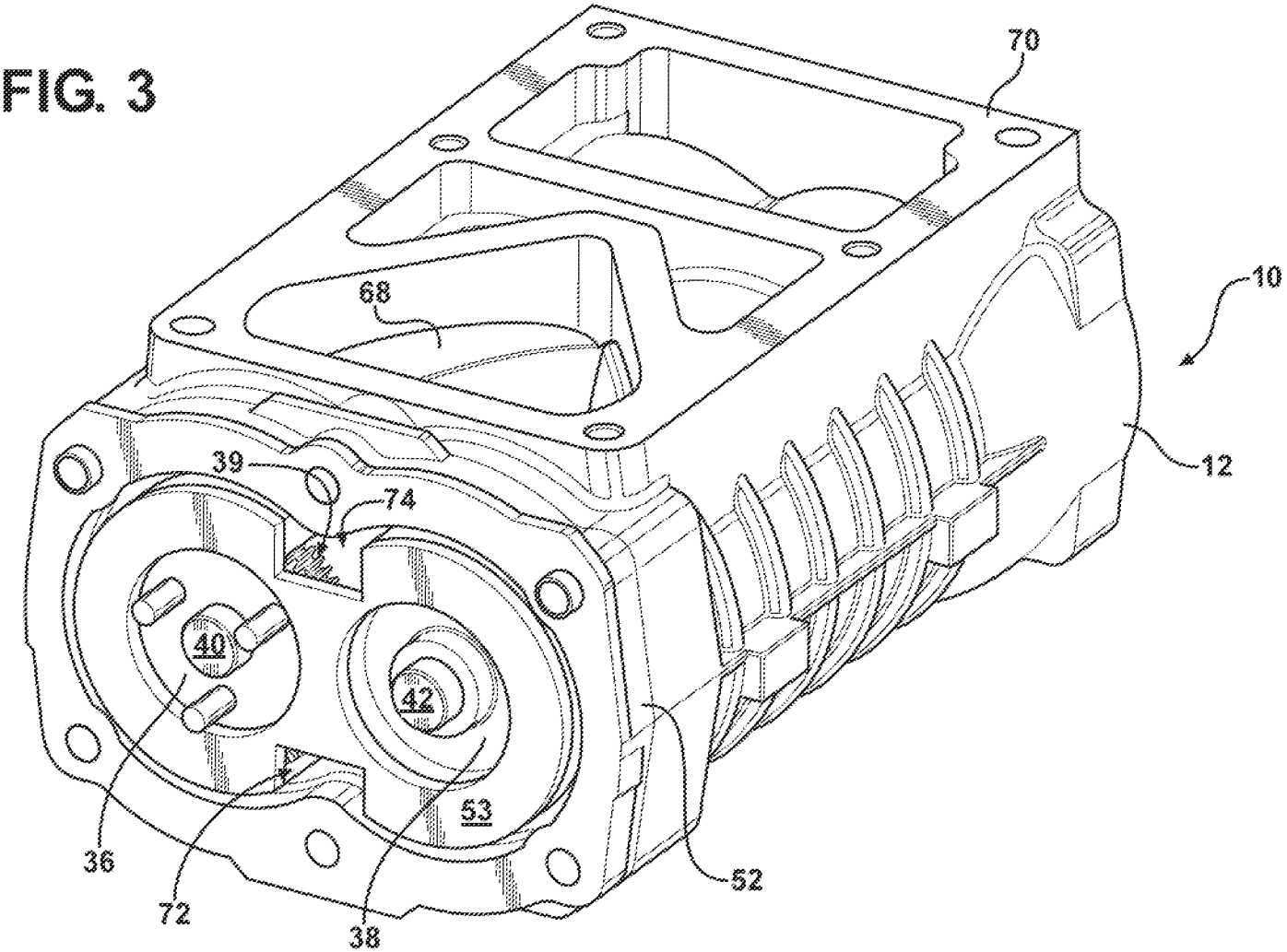
FIG. 3 is a perspective bottom view of the supercharger assembly with input shaft housing removed to show a cover member adapted to enclose the meshed timing gears.

The supercharger assembly 10 is shown in detail in FIGS. 2-3. Supercharger assembly 10 includes an input drive 11 adapted to be rotatably driven by a positive torque, about an axis of rotation X at speeds proportional to speeds of an internal combustion engine. The input drive 11 includes a housing 12. The housing 12 is typically formed from cast metal such as, for example, aluminum, magnesium, etc. The housing 12 includes a first end 14 and an opposed second end 16. The first end 14 includes an attachment provision for an input-shaft housing 18. An input-shaft 20 having a first end 22 and a second end 24 is arranged internally to the input-shaft housing 18. Input-shaft 20 is rotatably supported in the input-shaft housing 18 by bearings 26 and 28. A rotary seal 29 is mounted in the input-shaft housing 18. Seal 29 is arranged such that the seal's inner diameter contacts the outer diameter of input-shaft 20 and prevents foreign material from entering housing 18 from outside the supercharger assembly 10, and any fluid from escaping in the opposite direction.

The first end 22 of the input-shaft 20 fixedly receives a pulley 30 that is connected to crankshaft pulley 6 via belt 8, such that the supercharger assembly 10 is driven by the engine 2 (as shown in FIG. 1). The second end 24 of the input-shaft 20 holds a flange 32 for engaging a coupler 34 that in turn engages a first or driving timing gear 36 via studs 37. Driving timing gear 36 continuously meshes with a second or driven timing gear 38. Hence, the input drive 11 directly drives the first and second timing gears 36 and 38. The timing gears 36 and 38 are fixed relative to first and second rotor shafts 40 and 42, respectively. Rotor shaft 40 is rotatably mounted on a first front bearing 44 and on a first rear bearing 46, while rotor shaft 42 is similarly mounted on a second front bearing 48 and on a second rear bearing 50. First and second front bearings 44 and 48 are mounted and supported in a bearing plate 52, while first and second rear bearings 46 and 50 are mounted and supported in the housing 12.

Rotor shafts 40 and 42 are fixed to first and second interleaved and continuously meshed rotors 54 and 56, respectively, for unitary rotation therewith. The meshed timing gears 36 and 38 are therefore fixed relative to the rotors 54 and 56, respectively, particularly in order to prevent contact between the rotors during operation of the supercharger assembly 10. Rotors 54 and 56 are mounted for synchronous rotation in a rotor cavity 58 formed in the housing 12, and are arranged to transfer relatively low-pressure inlet port air to relatively high-pressure outlet port air. Input-shaft housing 18 is directly mounted to bearing plate 52, thus forming an oil sump or gear case 60 between the bearing plate and the input-shaft housing. The timing gears 36 and 38 are therefore arranged to rotate within the confines of the oil sump 60. A first rotary seal 62 and a second rotary seal 64 are mounted on the bearing plate 52. Inner diameters of rotary seals 62 and 64 contact outer diameters of rotor shafts 40 and 42, respectively, to prevent leakage of lubricating fluid from the oil sump 60 into the rotor cavity 58.

The second end 16 of housing 12 includes low-pressure air inlet ports 66 arranged to admit typically ambient air to rotors 54 and 56. The relatively low-pressure air typically enters inlet ports 66 via a throttle body assembly (not shown) which controls the amount of incoming air based on engine speed and load. As is known by those skilled in the art, the relatively low-pressure inlet port air is compressed by the first and second rotors 54 and 56. Thus, the relatively low-pressure inlet port air is transformed by the first and second rotors 54 and 56 into relatively high-pressure outlet port air. The relatively high-pressure outlet port air is then discharged, and delivered via an air outlet port 68 (shown in FIG. 3) to combustion chambers 4 (shown in FIG. 1). The relatively high-pressure outlet port air is combined with fuel inside the engine for subsequent combustion. Supercharger assembly 10 is mounted on the engine at the outlet surface 70. Typically, supercharger assembly 10 is attached to engine 2 via a suitable fastening arrangement, such as multiple screws (not shown), to facilitate the most direct communication of the compressed air to combustion chambers 4.

Timing gears 36 and 38 are sufficiently enclosed by a bearing plate 52 and a cover member 53 to generate a sustained flow of pressurized lubricating fluid via gear teeth 39 during operation of supercharger assembly 10. The flow of the lubricating fluid provided by the timing gears 36 and 38, and hence the resultant fluid pressure, is proportional to the rotational speed of the input drive 11, as controlled by the speed of the engine via belt 8 (shown in FIG. 1). The flow of pressurized lubricating fluid is employed to cool and lubricate the supercharger's internal components in order to counteract heat generated by the supercharger under load.

The flow of the lubricating fluid generated by the timing gears 36 and 38 may either be contained within the sump 60, or be supplied from an outside source, i.e., external to the supercharger assembly 10, via dedicated external passages (not shown). Such external supply of lubricating fluid to the timing gears 36 and 38 will additionally permit a substantially vertical orientation of the supercharger assembly 10 with respect to the ground. Because the fluid supply to the timing gears 36 and 38 is not influenced by gravity, the first and second rotary seals 62 and 64 are not in danger of being submerged in fluid when the axis of rotation X is arranged substantially parallel to the direction of the force of gravity. Hence, in a vehicle, the supercharger assembly 10 may even be mounted on the engine with the input drive facing either substantially up or down relative to the ground. Consequently, an external supply of low-pressure fluid to the timing gears 36 and 38 provides added flexibility for packaging of the supercharger assembly 10.

Figure 4:
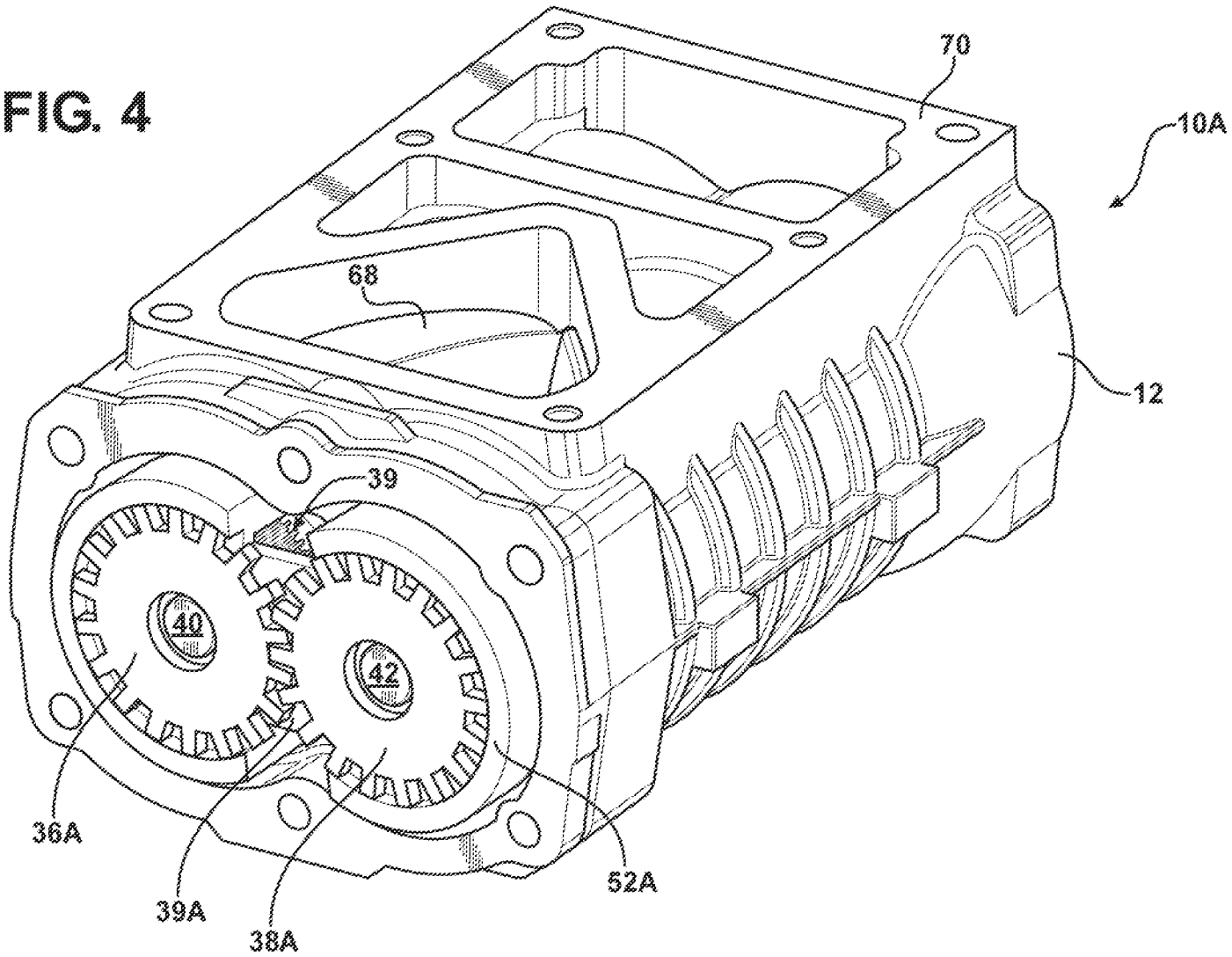
FIG. 4 is a perspective bottom view of a supercharger assembly with input shaft housing removed to show meshed rotary members arranged to generate fluid flow.

Referring to FIG. 4, there is shown a supercharger assembly 10A that is identical to supercharger assembly 10 shown in FIG. 3 in all respects other than having meshed rotary members 36A and 38A in addition to timing gears 36 and 38. In operation, when employed in conjunction with timing gears 36 and 38, meshed rotary members 36A and 38A aid timing gears 36 and 38 in providing the flow of pressurized lubricating fluid. When employed in conjunction with timing gears 36 and 38, meshed rotary members 36A and 38A may also be unaided in generating fluid flow. Meshed rotary members 36A and 38A are sufficiently enclosed by a bearing plate 52A and a cover member 53 (shown in FIGS. 2 and 3) to generate a sustained flow of lubricating fluid during operation of supercharger assembly 10 via teeth 39A. The flow of the lubricating fluid provided by the timing gears 36 and 38, and hence the resultant fluid pressure, is proportional to the rotational speed of the input drive 11, as controlled by the speed of the engine.

As shown in FIG. 3, the cover member 53 includes a fluid inlet port 72 to pull low-pressure fluid from the sump 60, or from an outside source, and a fluid outlet port 74 to deliver the pressurized fluid to wherever it may be desired. Although bearing plate 52 and cover member 53 of FIG. 3 are shown to enclose timing gears 36 and 38, generation of fluid flow may also be enabled without employing a separate cover 53. Pressurized flow of the lubricating fluid by timing gears 36 and 38 may be also enabled by configuring surfaces of input-shaft housing 18 and bearing plate 52 adjacent to the timing gears in close proximity to the timing gears' faces, such as with precise machining. Cover 53 having fluid inlet port 72 and fluid outlet port 74 may be similarly employed in supercharger assembly 10A (shown in FIG. 4). As with timing gears 36 and 38, however, pressurized fluid flow by timing gears 36A and 38A may be enabled by employing a close-fit between the timing gears, the input-shaft housing 18, and the bearing plate 52A.

Figure 5:
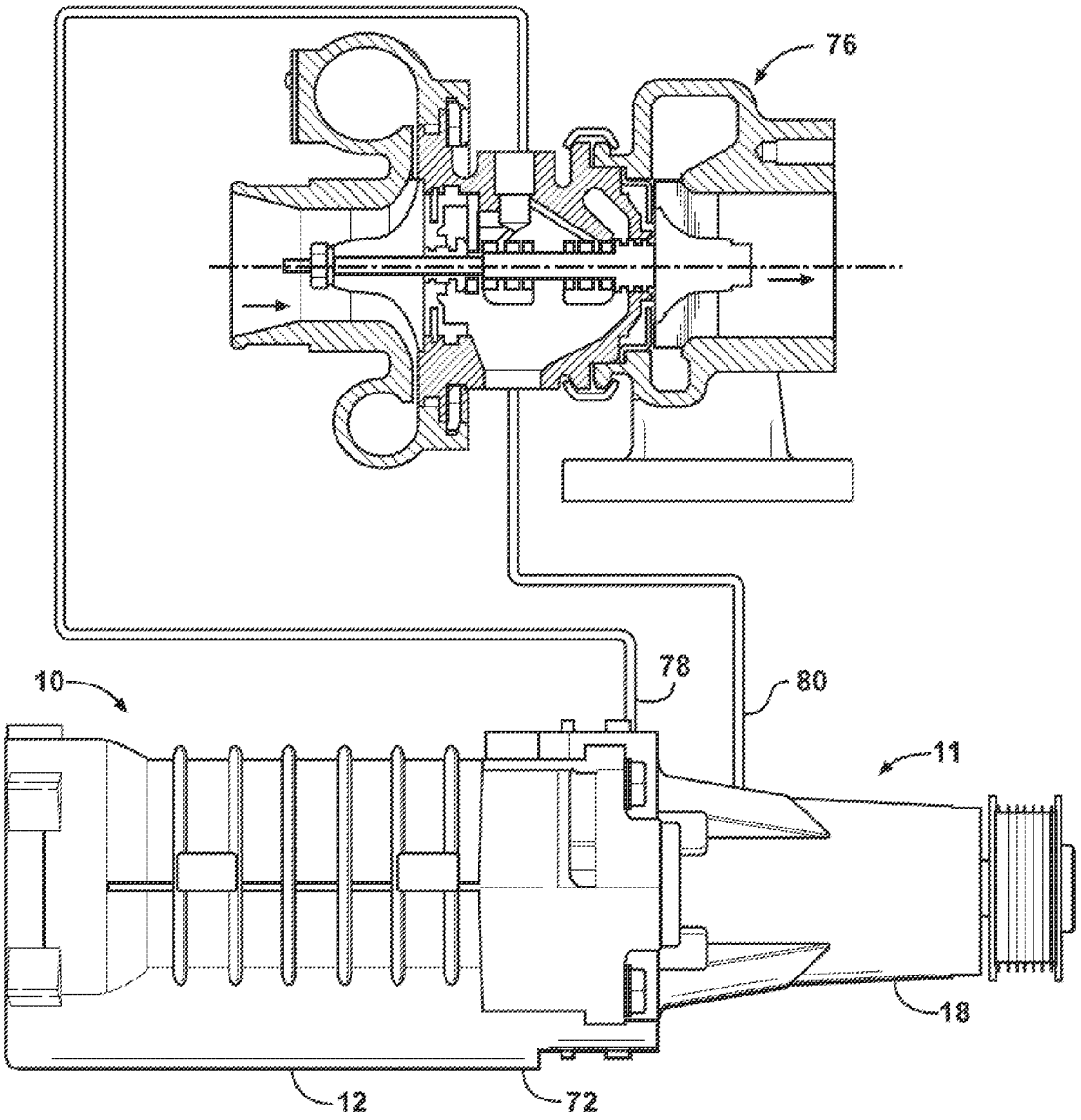
FIG. 5 is a side view of the supercharger assembly communicating pressurized lubricating fluid to a turbocharger.

The fluid flow generated by the timing gears 36 and 38, as well as meshed rotary members 36A and 38A, may be employed to lubricate the input drive 11 more effectively, as compared with non-pressurized, splash lubrication. The fluid pressurized by the timing gears 36 and 38 may also be communicated to an external device, such as a turbocharger assembly 76 shown in FIG. 5, that typically requires an externally provided supply of lubrication. FIG. 5 depicts the pressurized fluid flow generated by timing gears 36 and 38 being delivered to turbocharger assembly 76 via an oil inlet passage 78, and, after exiting the turbocharger, being carried back to the oil sump via an oil return passage 80.

Figure 6:
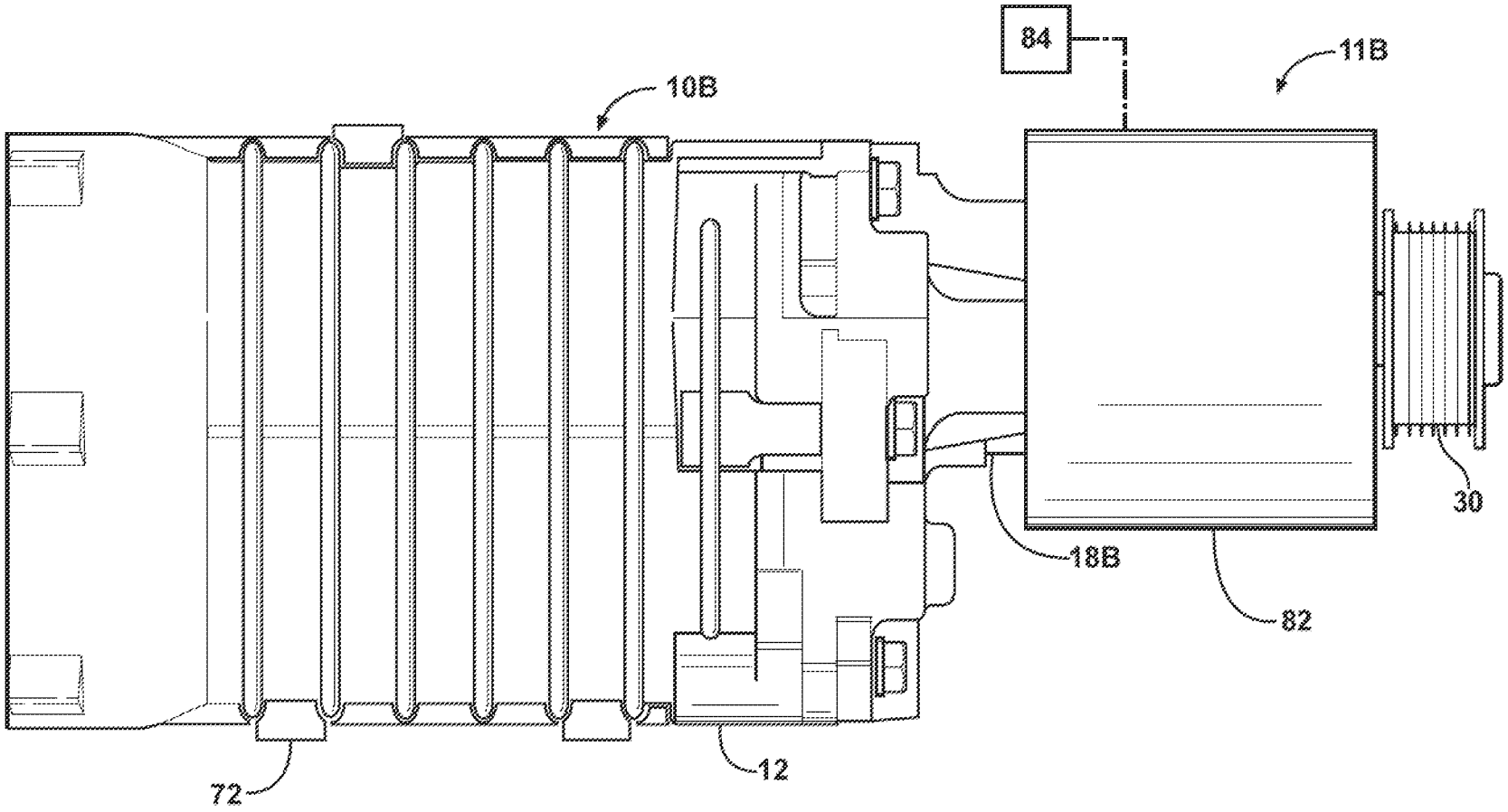
FIG. 6 is a top view of a supercharger assembly having a selectable speed input-drive.

Referring to FIG. 6, there is shown a supercharger assembly 10B that is identical to supercharger assembly 10 shown in FIG. 2 in all respects other than having an input drive 11B in place of the input drive 11. Input drive 11B includes a device 82 that connects pulley 30 to the driving timing gear 36 such that it is capable of providing a selectable speed input to the rotors 54 and 56. Thus, input drive 11B provides enhanced control of the rotating speed of rotors 54 and 56, as compared with input drive 11 of FIG. 2 that is structurally limited to providing a non-selectable direct-drive input to the rotors. Input drive 11B is controlled by an electronic control unit (ECU) 84. ECU 84 may be configured as a stand-alone unit, or may be incorporated into the engine controller.

The device 82 may achieve selectable multiple-speeds by employing a shiftable gear-set with multiple distinct ratio steps. Additionally, device 82 may employ a mechanism such as a continuously variable transmission (CVT) or an electrically-variable transmission (EVT), to vary input speeds continuously within a given range, as is known by those skilled in the art. Selectable speed input drive 11B envisioned herein typically requires heightened lubrication, as compared to the non-selectable direct-drive input drive 11. The pressurized fluid supplied by timing gears 36 and 38, however, may be sufficient to satisfy the heightened lubrication requirements of the input drive 11B, and obviate the need for additionally supplied lubrication. Hence, the input drive 11B may be characterized by the absence of lubrication provided by a source external to the supercharger assembly 10B.

While the best modes for carrying out the invention have been described in detail, those familiar with the art to which this invention relates will recognize various alternative designs and embodiments for practicing the invention within the scope of the appended claims.

The invention claimed is:

1. A positive displacement pump comprising:

a roots supercharger comprising:

a housing having an inlet port for admitting relatively low-pressure inlet port air and an outlet port for discharging relatively high-pressure outlet port air to the intake of an internal combustion engine;

first and second intermeshed lobed rotors rotatably disposed in the housing and configured to transform relatively low-pressure inlet port air into relatively high-pressure outlet port air to supply the internal combustion engine;

first and second meshed timing gears fixed relative to the first and second intermeshed lobed rotors, respectively, for preventing contact between the first and second intermeshed lobed rotors;

first and second meshed rotary members, wherein the first rotary member is fixed relative to the first timing gear, wherein the second rotary member is fixed relative to the second timing gear, wherein the first rotary member is meshed with the second rotary member;

a first bearing plate arranged to separate the first and second intermeshed lobed rotors from the first and second meshed timing gears; and a cover member having a fluid inlet port and a fluid outlet port, wherein the cover member in combination with the first bearing plate member encloses the timing gears, wherein the first and second meshed rotors are disposed on a side of the cover member opposite the timing gears; and a roots supercharger input drive adapted to be rotatably driven by a positive torque at speeds proportional to speeds of the internal combustion engine, and configured to drive the first and second meshed timing gears;

wherein the flow of lubricating fluid generated by the first and second meshed timing gears lubricates a device located external to the housing.

2. The pump of claim 1, wherein the input drive is configured as one of a multiple-speed ratio device and a continuously variable-speed device to provide a selectable speed ratio between the input drive and the first and second intermeshed lobed rotors.

3. The pump of claim 1, wherein the flow of lubricating fluid generated by the first and second meshed timing gears is proportional to the speed of the input drive.

4. The pump of claim 1, wherein the flow of lubricating fluid generated by the first and second meshed timing gears is communicated to a device arranged externally to the housing.

5. The pump of claim 1, wherein teeth of the first and second meshed timing gears are arranged to generate the flow of lubricating fluid.

6. The pump of claim 1, wherein the external device comprises a selectable speed control unit for controlling a rotating speed of the first and second intermeshed lobed rotors.

7. The pump of claim 6, wherein the external device is located within an input device housing connected to the housing.

8. The pump of claim 1, further comprising:

a first rotor shaft, wherein the first lobed rotor, the first timing gear, and the first rotary member are secured to the first rotor shaft, so as to rotate with in unison with the first rotor shaft; and a second rotor shaft, wherein the second lobed rotor, the second timing gear, and the second rotary member are secured to the second rotor shaft, so as to rotate with in unison with the second rotor shaft.

9. An internal combustion engine comprising:

a combustion chamber;

a roots supercharger having an axis of rotation, the roots supercharger including:

a housing having an inlet port for admitting relatively low-pressure inlet port air and an outlet port for delivering relatively high-pressure outlet port air to the combustion chamber;

first and second intermeshed lobed rotors rotatably disposed in the housing and configured to transform relatively low-pressure inlet port air into relatively high-pressure outlet port air;

first and second meshed timing gears fixed relative to the first and second intermeshed lobed rotors, respectively, for preventing contact between the first and second intermeshed lobed rotors;

first and second meshed rotary members, wherein the first rotary member is fixed relative to the first timing gear, wherein the second rotary member is fixed relative to the second timing gear, wherein the first rotary member is meshed with the second rotary member;

a first bearing plate arranged to separate the first and second intermeshed lobed rotors from the first and second meshed timing gears; and a cover member having a fluid inlet port and a fluid outlet port, wherein the cover member in combination with the first bearing plate member encloses the timing gears, wherein the first and second meshed rotors are disposed on a side of the cover member opposite the timing gears; and a roots supercharger input drive adapted to be rotatably driven by a positive torque at speeds proportional to speeds of the internal combustion engine and configured to drive the first and second meshed timing gears;

wherein the flow of lubricating fluid generated by the first and second meshed timing gears lubricates a device located external to the housing.

10. The engine of claim 9, wherein the input drive is configured as one of a multiple-speed ratio device and a continuously variable-speed device to provide a selectable speed ratio between the input drive and the first and second intermeshed lobed rotors.

11. The engine of claim 9, wherein the flow of lubricating fluid generated by the first and second meshed timing gears is proportional to the speed of the input drive.

12. The engine of claim 9, wherein the flow of lubricating fluid generated by the first and second meshed timing gears is communicated to a device arranged externally to the housing.

13. The engine of claim 9, wherein teeth of the first and second meshed timing gears are arranged to generate the flow of lubricating fluid.

14. The engine of claim 9, wherein first and second rotary fluid seals are disposed in the housing along the axis of rotation relative to the first and second meshed rotors, and the fluid is provided to the first and second meshed timing gears from a source external to the positive displacement pump, such that the first and second rotary fluid seals are not submerged in fluid when the axis of rotation is arranged substantially parallel to the direction of the force of gravity.

15. The internal combustion engine of claim 9, wherein the external device further comprises a selectable speed control unit for controlling a rotating speed of the first and second intermeshed lobed rotors.

16. The engine of claim 9, further comprising:

a first rotor shaft, wherein the first lobed rotor, the first timing gear, and the first rotary member are secured to the first rotor shaft, so as to rotate with in unison with the first rotor shaft; and a second rotor shaft, wherein the second lobed rotor, the second timing gear, and the second rotary member are secured to the second rotor shaft, so as to rotate with in unison with the second rotor shaft.

17. A roots supercharger comprising:

a rotor housing having an inlet port for admitting relatively low-pressure inlet port air and an outlet port for discharging relatively high-pressure outlet port air;

first and second intermeshed lobed rotors rotatably disposed in the rotor housing and configured to transform relatively low-pressure inlet port air into relatively high-pressure outlet port air;

first and second meshed timing gears fixed relative to the first and second intermeshed lobed rotors, respectively, for preventing contact between the first and second intermeshed lobed rotors;

first and second meshed rotary members, wherein the first rotary member is fixed relative to the first timing gear, wherein the second rotary member is fixed relative to the second timing gear, wherein the first rotary member is meshed with the second rotary member;

a first bearing plate arranged to separate the first and second intermeshed lobed rotors from the first and second meshed timing gears;

a cover member having a fluid inlet port and a fluid outlet port, wherein the cover member in combination with the first bearing plate member encloses the timing gears, wherein the first and second meshed rotors are disposed on a side of the cover member opposite the timing gears; and an input drive housing connected to the rotor housing;

an input drive located within the input drive housing and adapted to be rotatably driven by a positive torque at speeds proportional to speeds of an internal combustion engine, and configured to drive the first and second meshed timing gears; and wherein the flow of lubricating fluid generated by the first and second meshed timing gears lubricates the input drive.

18. The roots supercharger of claim 17, wherein the input drive is configured as a continuously variable-speed device to provide a selectable speed ratio between the input drive and the first and second meshed rotors.

19. The roots supercharger of claim 17, wherein the input drive is characterized by the absence of lubrication provided by a source external to the pump, and wherein the flow of lubricating fluid generated by the first and second meshed timing gears is proportional to the speed of the input drive.

20. The roots supercharger of claim 17, wherein the flow of lubricating fluid generated by the first and second meshed timing gears is communicated to a device arranged externally to the housing.

21. The roots supercharger of claim 17, further comprising:

a first rotor shaft, wherein the first lobed rotor, the first timing gear, and the first rotary member are secured to the first rotor shaft, so as to rotate with in unison with the first rotor shaft; and a second rotor shaft, wherein the second lobed rotor, the second timing gear, and the second rotary member are secured to the second rotor shaft, so as to rotate with in unison with the second rotor shaft.

* * * * *